US009974381B2

(12) United States Patent
Shafer et al.

(10) Patent No.: US 9,974,381 B2
(45) Date of Patent: May 22, 2018

(54) CLEANING DEVICE HAVING ONBOARD REPLACEABLE CLEANING PAD AND ONBOARD REPLACEABLE CLEANING SOLUTION

(71) Applicant: The Procter & Gamble Company, Cincinnati, OH (US)

(72) Inventors: Adam Robert-George Shafer, Cincinnati, OH (US); David William Schuller, Lebanon, OH (US); Igor Ivanovich Zemskov, Dublin, OH (US); Rainer Bernhard Teufel, Worthington, OH (US); Richard Lee Lane, Columbus, OH (US); Sun-Jan Alan Huang, Pittsburgh, PA (US)

(73) Assignee: The procter & Gamble Company, Cincinnati, OH (US)

( * ) Notice: Subject to any disclaimer, the term of this patent is extended or adjusted under 35 U.S.C. 154(b) by 0 days. days.

(21) Appl. No.: 14/700,482

(22) Filed: Apr. 30, 2015

(65) Prior Publication Data

US 2015/0238005 A1 Aug. 27, 2015

Related U.S. Application Data

(63) Continuation of application No. 13/523,432, filed on Jun. 14, 2012, now Pat. No. 9,044,852.

(Continued)

(51) Int. Cl.

*A46B 11/00* (2006.01)
*A47L 13/12* (2006.01)

(Continued)

(52) U.S. Cl.

CPC ..... *A46B 11/0017* (2013.01); *A46B 9/02* (2013.01); *A46B 9/10* (2013.01); *A46B 11/0065* (2013.01);

(Continued)

(58) Field of Classification Search

CPC ..... A46B 9/02; A46B 9/026; A46B 11/0017; A47L 13/12; A47L 13/17; A47L 13/254; A47L 13/256; A47L 13/257; A47L 13/258

See application file for complete search history.

(56) References Cited

U.S. PATENT DOCUMENTS 1,603,388 A 10/1926 Hill
1,729,934 A 10/1929 Gordon (Continued)

FOREIGN PATENT DOCUMENTS

EP 1868745 B1 2/2012
GB 1303249 A 1/1973

(Continued)

OTHER PUBLICATIONS

U.S. Appl. No. 29/424,663, filed Jun. 14, 2012, Shafer, et al.

(Continued)

*Primary Examiner* — Jennifer C Chiang
*Assistant Examiner* — Bradley Oliver
(74) *Attorney, Agent, or Firm* — Larry L. Huston

(57) ABSTRACT

A device for cleaning debris from a target surface. The device has a sole plate with permanent cleaning material, such as bristles, and a removable/replaceable pad. The device also has a replaceable, on-board supply of cleaning solution. The pad/cleaning solution may be replaced when depleted and replaced with a new pad/cleaning solution or may simply be replaced with a new pad/cleaning solution when that pad/cleaning solution is more suitable for a particular cleaning task.

18 Claims, 13 Drawing Sheets

Related U.S. Application Data

(60) Provisional application No. 61/526,097, filed on Aug. 22, 2011.

(51) Int. Cl.

| | |
|---|---|
| ***A47L 13/17*** | (2006.01) |
| ***B25G 1/10*** | (2006.01) |
| ***B25G 3/08*** | (2006.01) |
| ***B25G 3/38*** | (2006.01) |
| ***A47L 13/26*** | (2006.01) |
| ***A47L 1/06*** | (2006.01) |
| ***A46B 9/02*** | (2006.01) |
| ***A46B 9/10*** | (2006.01) |
| *A46B 9/06* | (2006.01) |

(52) U.S. Cl.

CPC ..... *A47L 1/06* (2013.01); *A47L 13/12* (2013.01); *A47L 13/17* (2013.01); *A47L 13/26* (2013.01); *B25G 1/102* (2013.01); *B25G 3/08* (2013.01); *B25G 3/38* (2013.01); *A46B 9/06* (2013.01); *A46B 2200/3033* (2013.01)

(56) References Cited

U.S. PATENT DOCUMENTS

| | | | |
|---|---|---|---|
| 2,469,060 | A | 5/1949 | Vosbikian |
| 2,701,888 | A | 2/1955 | Vosbikian |
| 3,113,703 | A | 12/1960 | Rundle |
| 3,199,136 | A | 8/1965 | George |
| 3,722,021 | A | 3/1973 | Brainerd |
| 2,859,463 | A | 11/1985 | Hirsch |
| 4,776,716 | A | 10/1988 | Huang |
| 4,859,102 | A | 8/1989 | Chamieh |
| 5,222,110 | A | 6/1993 | Borofsky |
| 5,299,876 | A | 4/1994 | Singarella |
| 5,479,673 | A | 1/1996 | Carton |
| 6,020,303 | A | 2/2000 | Cripe et al. |
| 6,224,283 | B1 | 5/2001 | Hay |
| 6,487,746 | B1 | 12/2002 | Cioci |
| 6,595,712 | B2 | 7/2003 | Sickler |
| 6,669,391 | B2 | 12/2003 | Policicchio et al. |
| 6,866,165 | B2 | 3/2005 | Heathcock et al. |
| 6,872,021 | B1 | 3/2005 | Wilson et al. |
| D513,102 | S | 12/2005 | Davis-Wilson et al. |
| 7,007,338 | B2 | 3/2006 | Garabedian, Jr. et al. |
| 7,021,494 | B2 | 4/2006 | Mazooji et al. |
| D522,201 | S | 5/2006 | Davis-Wilson et al. |
| 7,192,210 | B2 | 3/2007 | Svendsen et al. |
| D547,016 | S | 6/2007 | Santiago et al. |
| D578,720 | S | 10/2008 | Norcorn et al. |
| 7,584,518 | B1 | 9/2009 | Morad |
| 7,624,469 | B2 | 12/2009 | Specht et al. |
| 7,629,043 | B2 | 12/2009 | Lindsay et al. |
| 7,682,097 | B2 | 3/2010 | Knopow et al. |
| 7,824,120 | B1 | 11/2010 | Kasper |
| 8,267,607 | B2 | 9/2012 | Harris |
| 8,549,690 | B2 | 10/2013 | Vasilakes et al. |
| 2004/0071490 | A1 | 4/2004 | Vosbikian et al. |
| 2004/0101347 | A1 | 5/2004 | Beard |
| 2004/0231700 | A1 | 11/2004 | Bell et al. |
| 2004/0265037 | A1 | 12/2004 | Vosbikian et al. |
| 2005/0086754 | A1 | 4/2005 | Dalias |
| 2006/0168750 | A1 | 8/2006 | Dotterman et al. |
| 2006/0230567 | A1* | 10/2006 | Harper ..... A47L 13/254 15/228 |
| 2007/0071535 | A1 | 3/2007 | Young et al. |
| 2007/0077113 | A1 | 4/2007 | Nanda |
| 2007/0136963 | A1 | 6/2007 | Vosbikian et al. |
| 2008/0016634 | A1 | 1/2008 | Vosbikian et al. |
| 2009/0235476 | A1 | 9/2009 | Cioci |
| 2010/0154822 | A1 | 6/2010 | Reed et al. |
| 2011/0107545 | A1 | 5/2011 | Cagnina et al. |
| 2011/0226638 | A1 | 9/2011 | Hoadley et al. |
| 2012/0096662 | A1 | 4/2012 | Uchiyama et al. |
| 2012/0301208 | A1 | 11/2012 | Hughes et al. |
| 2013/0043329 | A1* | 2/2013 | Bradbury ..... A46B 11/0017 222/630 |
| 2013/0104327 | A1 | 5/2013 | Borofsky |

FOREIGN PATENT DOCUMENTS

| | | | |
|---|---|---|---|
| WO | WO 2005/084516 | A1 | 9/2004 |
| WO | WO 2004/96001 | A1 | 11/2004 |
| WO | WO 00/05112688 | A1 | 12/2005 |
| WO | WO 2006/83629 | A1 | 10/2006 |
| WO | WO 2009/021103 | A2 | 2/2009 |

OTHER PUBLICATIONS

U.S. Appl. No. 29/373,644, filed Apr. 25, 2011, Teufel, et al.
Commercially available Products downloaded from the internet Aug. 2010, 21 Pages.

* cited by examiner

CLEANING DEVICE HAVING ONBOARD REPLACEABLE CLEANING PAD AND ONBOARD REPLACEABLE CLEANING SOLUTION

FIELD OF THE INVENTION

The present invention relates to cleaning devices and more particularly to cleaning devices usable to remove plural kinds of debris deposited on a hard surface.

BACKGROUND OF THE INVENTION

Cleaning devices for hard surfaces are well known in the art. Such devices may be handheld or may be deployed on the end of an elongate handle, to extend the user's reach.

The head of the device may include bristles, sponge, microfiber cloth, terry cloth, nonwoven sheets, foam and other cleaning materials, as are known in the art. But cleaning material well suited for cleaning one type of debris from a particular surface may be poorly suited for cleaning different debris from that same surface. Or that material may be poorly suited for cleaning that same debris from a different surface.

For example, one may desire to clean a shower area. The shower area may have different kinds of tile, each with different surface characteristics. The shower area may further have glass, marble, synthetic solid surface material, grout, caulk, plastic and/or ceramic surfaces. Each of these surfaces may require different treatments to optimize cleaning. For example, a cleaning material which works well on glass or ceramic might scratch a plastic surface. A cleaning material suitable for flat surfaces may not work well for faucets or corners.

Complicating the situation are the various types of debris found on a common surface. A single surface may have soluble and insoluble debris, oil-based debris, soap scum, food stains, mold, etc. Or plural surfaces in a single area, such as, by way of non-limiting example, a shower, may have plural types of debris—further complicating the cleaning task.

Further complicating the cleaning task is the interaction between the cleaning material and any cleaning solution used therewith. Particular cleaning solutions may work more efficaciously with particular cleaning pads.

A single cleaning pad is not optimized to clean plural types of debris from plural types of surfaces in a single cleaning task. One solution to this problem is for the user to interrupt the cleaning process mid-task and exchange the cleaning device for another. But this solution complicates the problem by requiring the purchase and storage of plural cleaning devices/pads/cleaning solutions—as well as extending the time necessary to complete the cleaning task.

An attempt to improve upon this solution is to provide a cleaning device having plural cleaning surfaces. For example, a cleaning device having dual texture bristles are known in the art. A device having a separately usable scrubber and sponge, is taught by U.S. Pat. No. 7,624,469. Some cleaning devices have renewable surfaces, as illustrated by commonly assigned U.S. Pat. Nos. D513,102 S; D522,201 S and D578,720 S. Another device accommodates a continuous liquid flow path, as taught by U.S. Pat. No. 6,595,712.

But these attempts in the art do not overcome the problems encountered when using a single device to clean plural surfaces having plural types of debris. Accordingly, a new solution is needed.

SUMMARY OF THE INVENTION

The invention comprises a device for cleaning debris from a target surface. The device has a sole plate with a permanent cleaning surface and a removable/replaceable cleaning surface. The replaceable cleaning surface may comprise a pad. The device also has a replaceable, on-board supply of cleaning solution. The pad/cleaning solution may be replaced when depleted and replaced with a new pad/cleaning solution or may simply be replaced with a new pad/cleaning solution which may be more suitable for a particular cleaning task.

DETAILED DESCRIPTION OF THE INVENTION

Figure 1:
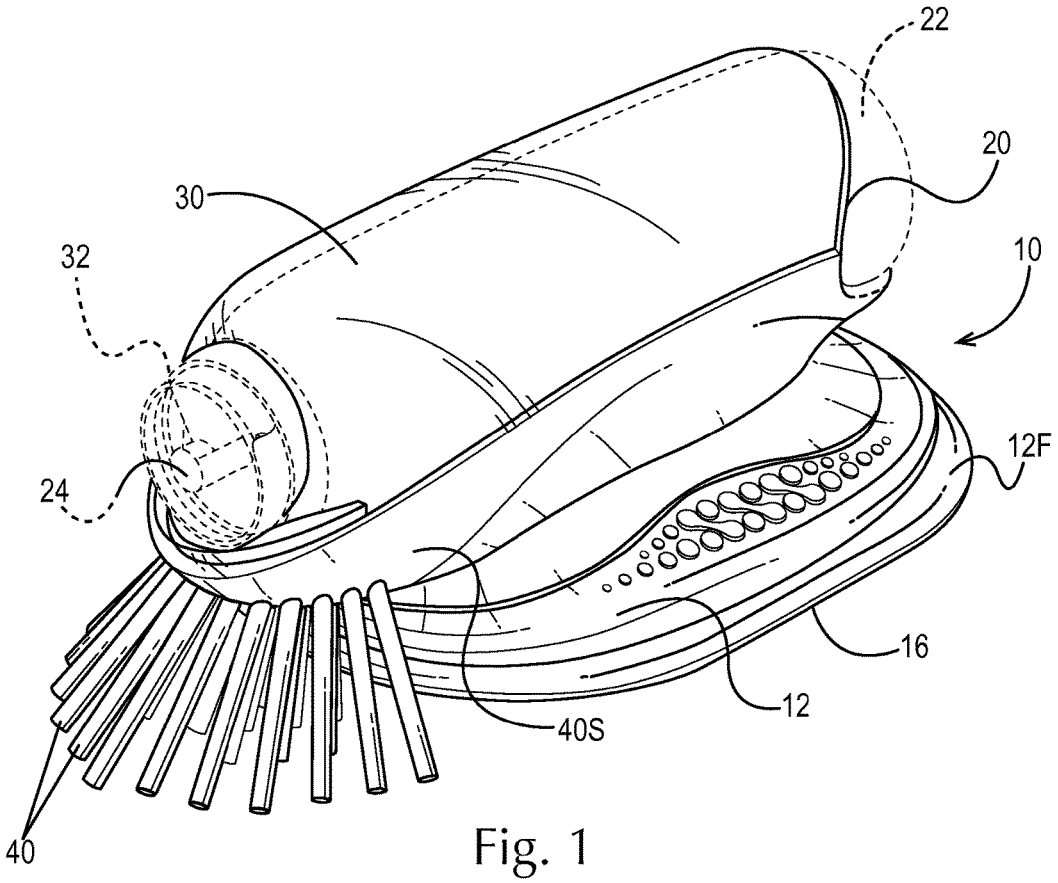
FIG. 1 is a perspective view of a cleaning device according to the present invention.

Referring to FIG. 1, the device 10 according to the present invention comprises a sole plate 12 and bristles 13 for contacting the surface to be cleaned, a handle 30, and a renewable cleaning solution supply. The sole plate 12 has a top 14, or upwardly facing surface to which the handle 30 may be attached. The device 10 may further have a nozzle 24 for dispensing cleaning solution therefrom and directly or indirectly onto the target surface to be cleaned.

Figure 3:
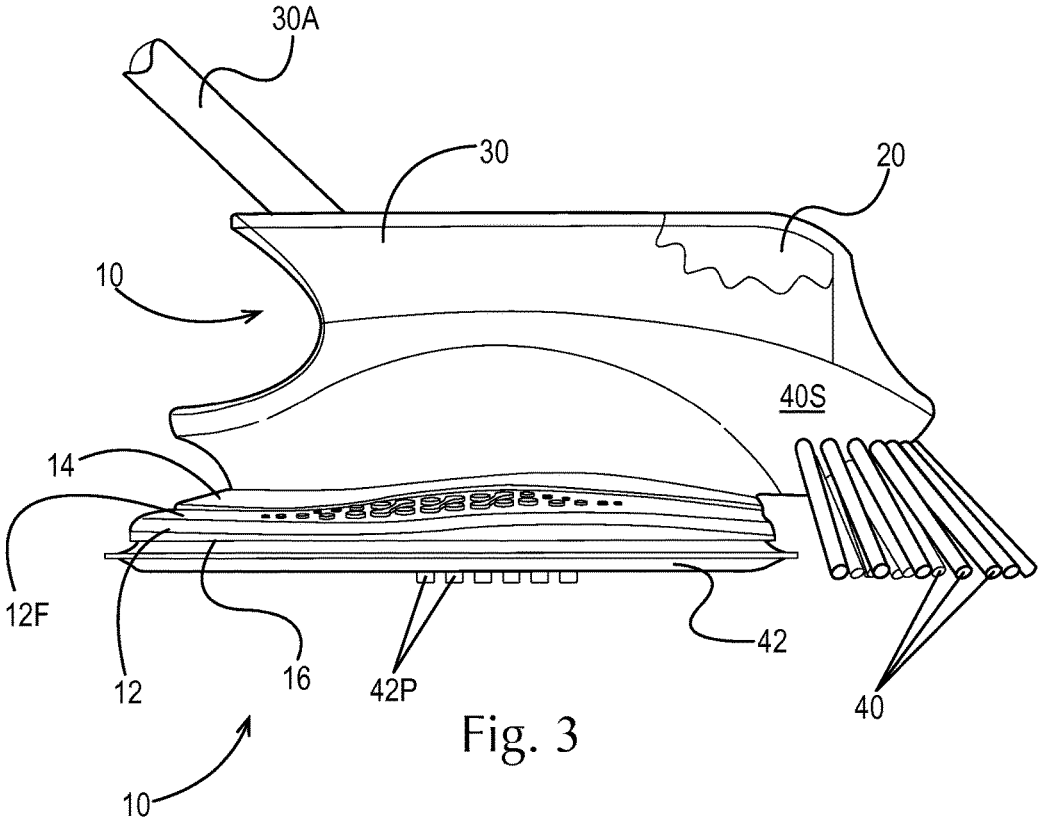
FIG. 3 is a side elevational view of the device of FIG. 1 having a hollow handle shown partially in cutaway, and an optional elongate handle in phantom.
Figure 4:
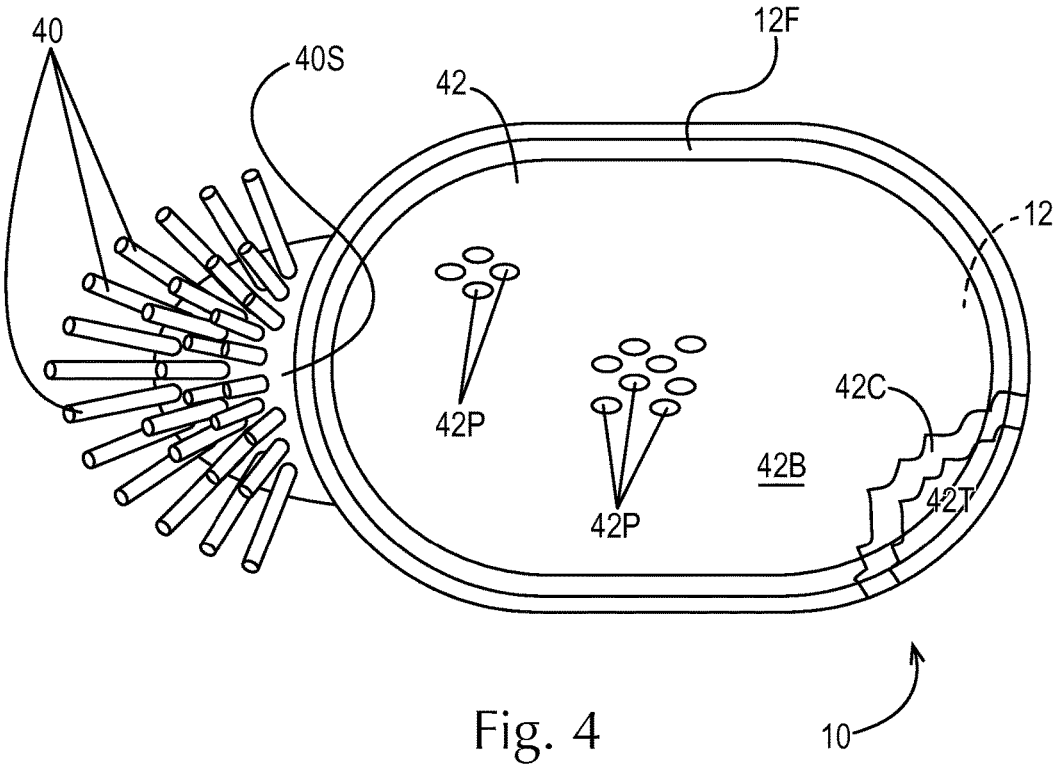
FIG. 4 is a bottom plan view of the device of FIG. 1, having the replaceable pad shown partially in cutaway.

Referring to FIGS. 3-4, the sole plate 12 further has a bottom 16 which is a downwardly facing surface. The bottom 16 of the sole plate 12 may be flat, slightly concave, slightly convex or a combination thereof. Above the sole plate 12, the device 10 may further comprise a receptacle 20 for receiving a supply of the cleaning solution. The receptacle 20 may be disposed within the handle 30. A disposable pad 42 may be removably attached to the sole plate 12.

Figure 2:
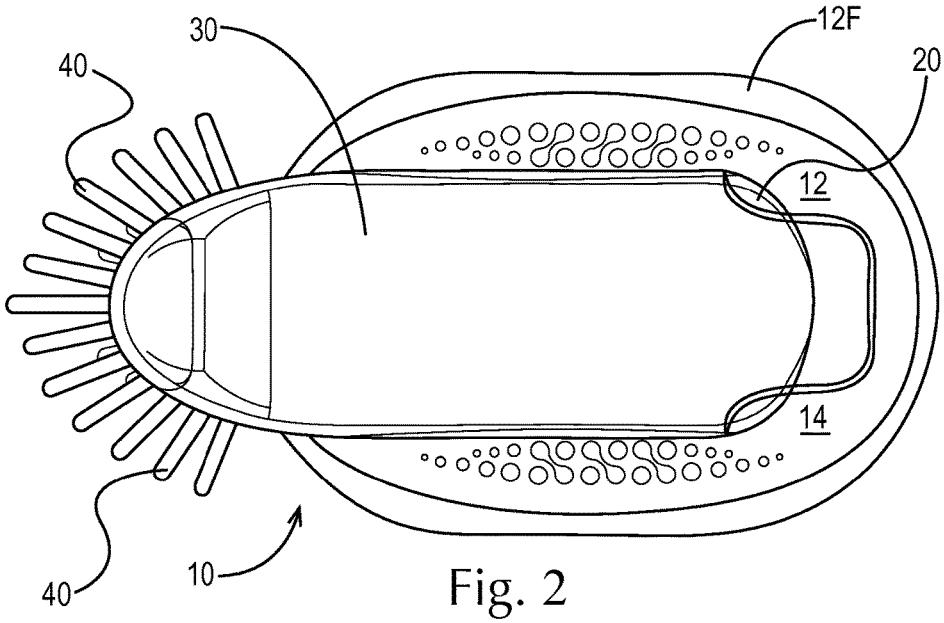
FIG. 2 is a top plan view of the device FIG. 1.

Referring FIGS. 1-2, and examining the device 10 in more detail, the device 10 may have a longitudinal axis L-L. The device 10 may be symmetric or asymmetric about the longitudinal axis L-L.

The device 10 may have a reservoir 20 of cleaning solution or one or more containers 22 of cleaning solution. The cleaning solution or container 22 thereof may have a volume of less than 250, 200, 150, or 100 ml. The device 10 may have a weight of, less than 750, 700, 650, 600, 550, 500, 450, 400, 350, 300, or 250 grams with the container 22 of cleaning solution and the pad 42 installed. Such a relatively light weight is particularly suitable for a cleaning device 10 having a handle 30 intended for single hand operation. If the device 10 has an elongate handle 30A, the device 10 may be slightly heavier, due to the two-handed operation possible with the elongate handle 30A.

To keep the center of gravity near the handle, the device 10 may have a container 22 installed within the receptacle 20. The receptacle 20, and any container 22 installed therein may be intermediate the top 14 of the sole plate 12 and the handle 30. The receptacle 20, and any container 22 installed therein may be disposed above the bottom 16 of the sole plate 12 and within the handle 30. This arrangement provides a center of gravity disposed juxtaposed with center of the device 10.

Referring to FIG. 3, the sole plate 12 may be generally flat, having a top 14 and a bottom 16 generally opposed thereto. The optional handle 30 may be a grip style handle 30 as shown, and may be joined to the top 14 of the sole plate 12.

The sole plate 12 may be flexible and bend, compress or otherwise deform into corners and other irregular surfaces under normal usage forces. The sole plate 12 may be resiliently deformable. By resiliently deformable it is mean that at least a portion of the sole plate 12 deforms, bends or otherwise conforms to a target surface under ordinary compressive forces applied in use, and returns to substantially its original shape when the compressive force is removed.

The sole plate 12 may comprise any such resiliently deformable material, such as EVA, natural foam, rubber, polypropylene, etc. If rubber is selected, the rubber may have a Shore A durometer hardness as set forth in Table I below:

TABLE I

| Durometer Range | Flexibility Evaluation |
|---|---|
| less than 20 | Too Soft |
| 20-25 | good/ideal |
| 25-30 | ideal |
| 30-35 | ideal/good |
| 35-40 and greater | too stiff |

Table I shows that the sole plate 12 may have a Shore A durometer hardness ranging from 20 to 35 and more particularly from 25-30. Such a hardness may be used with a sole plate 12 having a thickness at the perimeter ranging from 1 to 20, and particularly 2 to 15 mm. The center of the sole plate 12 may be thinner, as it does not need to flex and will be supported by the device. The proximal end of the flange 12F may have a thickness of 15 mm. The distal end of the flange 12F may have a thickness of 6 mm. It will be apparent to one of skill that as the hardness property or thickness property is adjusted, the other property may be adjusted in inverse relationship.

If polypropylene is selected, the sole plate 12 may have a sufficiently flexible flange 12F, to allow flexing to occur in use. Flexibility may be enhanced by having a relatively thin flange 12F, and/or a tapered flange 12F.

Referring to FIGS. 3 and 4, the bottom 16 of the sole plate 12 may comprise the cleaning surface. Such a cleaning surface may comprise plural cleaning materials such as permanent bristles 40, sponge, nonwoven scrubby material made of nylon, polypropylene, PET, PE, etc. and combinations thereof. Alternatively, a disposable and replacable pad 42 may be removably attached to the sole plate 12 to provide the cleaning surface.

The bottom 16 of the sole plate 12 may comprise one or more features which accommodate removable placement of the pad 42 thereon. The pad 42 may be discarded at the end of the cleaning task, during the cleaning task and replaced with a fresh pad 42 if necessary, or may be replaced with a different pad 42 better suited to a particular cleaning task.

Referring to FIGS. 1, 3 and 4, the replaceable pad 42 may be removably attached to the bottom 16 of the sole plate 12 using hook and loop type fasteners 44, adhesive disposed on the replaceable pad 42 and combinations thereof. The hook fasteners 44 may be molded into the bottom 16 of the sole plate 12 and the complementary loop material may be provided by the replaceable pad 42 and inherent in the material thereof.

The sole plate 12 may have a periphery which comprises a flange 12F, which defines the perimeter of the sole plate 12. The flange 12F provides a cantilevered portion of the periphery of the sole plate 12 which is easily deformable to reach into corners and conform to various irregularities in the target surface. The flange 12F may be tapered to become thinner at the edge. Deformation of the flange 12F particularly allows the sole plate 12, and any pad 42 attached thereto to reach corners and other undulations.

The optional handle 30, if present, may be parallel the longitudinal axis L-L as shown, skewed relative thereto or perpendicular thereto. The handle 30 may be generally parallel to the bottom 16 of the sole plate 12, as shown. If the handle 30 is not present, the user may grip the sides of the cleaning device 10 for manipulation during the cleaning process.

The front of the device 10 may have a point, for reaching into corners. The back of the device 10 may comprise a receptacle 20 for receiving a supply of the cleaning solution. Alternatively, the receptacle 20 for the cleaning solution may be disposed on the top of the device 10. For example, the handle 30 may be hollow and comprise a reservoir to be the receptacle 20 to contain the cleaning solution. If desire the receptacle 20, and container 22 each may have a longitudinal axis, which axis is coincident the longitudinal axis of the device 10.

The front of the device 10 may comprise a permanent cleaning material. Permanent cleaning materials include those which are replacable after years of use, for example using a modular construction.

The permanent cleaning material may last for the life of the device 10 and does not need replacement after one or a few cleaning tasks. The permanent cleaning material may come to a point, for reaching into corners or other tight spaces. The permanent cleaning material may comprise foam, textured polyolefinic film, nonwoven scrubbie material, steel wool, a squeegee, asperities in the hard plastic of the device 10, bristles 40 and combinations thereof.

Referring to FIGS. 2-4, the bristles 40 may be disposed at the front of the device 10, being cantilevered from proximal ends and extending to distal ends which contact the target surface. The bristles 40 may be permanent, so that replacement thereof during the life of the device 10 is unnecessary. Tufts comprising plural bristles 40 or a single, larger bristle 40, such as a rubber fin or finger, are contemplated. The bristles 40 may be nylon, and bend during use, as is known in the art. The bristles 40 may be generally peripherally disposed about the perimeter of the sole plate 12, or may be concentrated near the front of the device 10 as shown. Optionally, the bristles, or other permanent cleaning material may be entirely omitted from the device.

The bristles 40, or other permanent cleaning material as selected, may come to a point, creating a vertex at the front of the device 10. The bristles 40 may form an included angle less than 90 degrees to not interfere with corners, and may particularly form an included angle ranging from 30 to 180, or 50 to 70 degrees. Alternatively the bristles 40 may be disposed in an arcuate footprint and more particularly may have a semi-circular footprint with a tangent at the front.

The bristles 40 may be disposed on, and cantilevered from a bristle surface 40S. The bristle surface 40S may be disposed on the bottom of the device 10, and more particularly on a portion of the bottom which is not coincident with and not coplanar with the bottom of sole plate 12. The bristle surface 40S may be a portion of the bottom of the receptacle 20, or another portion of the device 10 which is not coplanar with the sole plate 12. The bristle surface 40S may be disposed above the sole plate 12 when it rests on a horizontal target surface.

If, as shown, the bottom of the arcuate receptacle 20 is the bristle surface 40S, the bristles 40 will be of different lengths so that all or most of the distal ends of the bristles 40 contact the target surface. The different lengths are necessary because the bottom of the receptacle 20 is arcuate and has different portions with different distances from the target surface. This arrangement provides the benefit that bristles of identical diameter and materials may be used, but will have different lengths.

The different lengths will provide different stiffnesses to the bristles 40. The different stiffnesses provide different cleaning capabilities for different stains and different shapes of target surfaces. Longer bristles 40 may be disposed at the front of the device 10 with shorter bristles disposed rearwardly thereof. The bottom of the pad 42, as installed in the device 10, and distal ends of the bristles 40, may be coplanar.

Contrary to the resiliency and deformability in use of the sole plate 12, the bristle surface 40S may be rigid and not deform in use. This arrangement allows the bristles 40 to be held in position and not deflect when scrubbing tough stains. The combination of a deformable sole plate 12 and rigid bristle surface 40S provides benefits that inside corners and other irregular surfaces can be reached, without compromising difficult stain removal.

If desired, plural types of bristles 40 may be utilized. A first plurality of bristles 40 may be perimetrically disposed about the periphery of the sole plate 12. The first plurality may be the outermost bristles 40 of the sole plate 12. The outermost bristles 40 may be relatively stiff, for scrubbing corners and edges. Further, the outermost bristles 40 may be disposed at an outwardly oriented angle relative to the bottom 16 of the sole plate 12. The outwardly oriented angle of the bristles 40 provides for reaching into corners and other hard-to-access areas.

The second plurality of bristles 40 may be disposed intermediate the first plurality of bristles 40 and the replaceable pad 42. The second plurality of bristles 40 may be less rigid, or in a variant embodiment more rigid, or in a degenerate case equally rigid as the first plurality of bristles 40. Likewise, the second plurality of bristles 40 may be longer, shorter, or of equal length as the first plurality of bristles 40. In yet another embodiment, the first plurality of bristles 40 and second plurality of bristles 40 may be intermixed as to properties such as rigidity, length, hydrophobicity, hydrophilicity, absorbency, etc. If desired, the bristles 40 may be coated with any of the cleaning solution chemistries described hereinbelow or otherwise known to one of ordinary skill.

The cleaning solution may be liquid, foam, gel or a combination thereof with or without particulates suspended therein. If desired, liquid cleaning solution may be provided in an aerosol container 22, as is known in the art. The aerosol container 22 may be metal, plastic such as PET, etc. and may be removably inserted into a complementary receptacle 20. The aerosol container 22 may have a longitudinal axis, defining the major dimension of that container 22. Suitable liquid cleaning solutions may comprise surfactants, organic acids, chelating agents, pH adjusting compounds, perfumes, disinfectants, anti-microbials, preservatives. etc.

The cleaning solution may comprise an aqueous detergent composition. This composition may contain C6 to C16, or more particularly C8 and/or C10 alkyl sulfate detergent surfactants, optional hydrophobic solvents, optional anionic surfactants, optional peroxide, optional hydrophilic solvent, optional mon- or poly-carboxylic acid and/or optional aqueous solvent systems. The pH may be any suitable value, and may range from 2 to 5. The cleaning solution may be made according to the teachings of commonly assigned U.S. Pat. No. 6,627,590.

The cleaning solution may be sprayed from the device 10 or container 22 through any suitable nozzle 24 or plurality of nozzles 24. In one embodiment, the cleaning solution may be forwardly sprayed in a fan pattern from a nozzle 24 coincident the longitudinal axis. Alternatively, the cleaning solution may be sprayed forward and laterally from a pair of nozzles 24 offset from the longitudinal axis. Alternatively, the nozzle 24 may be disposed in the handle 30, to provide more elevation of the spray pattern from the target surface. Or one or more nozzles 24 may be disposed on the bottom 16 of the sole plate 12. The nozzle 24 may also be a simple opening, to provide a dribble of the cleaning solution or may provide a spray, as is known in the art.

Any such nozzle 24 arrangement, and particularly a forward or laterally spraying nozzle 24 or plurality of nozzles 24, provides the benefit that the sprayed cleaning solution has residence time on the debris before being contacted by the bottom 16 of the sole plate 12. The residence time provides the benefit of solubilizing water soluble debris, for more efficacious cleaning of that debris. One suitable spray pattern is found in commonly assigned U.S. Pat. No. 8,186,898.

The spray maybe activated using a manual actuator, as is known in the art. One manual actuator may be a push button 32, as is known in the art. The pushbutton 32 is manually depressed by the user and may open a valve in the aerosol container 22, as is known in the art. The pushbutton 32 may be juxtaposed with the handle 30 so that the user can grip and manipulate the device 10 at the same time the pushbutton 32 is depressed. Or the push button 32 may be disposed directly on the container 22. This arrangement allows for cleaning a first area while simultaneously spraying a nearby second area to be cleaned.

Referring to FIGS. 2-3, the container 22 of cleaning solution may be removably inserted into the receptacle 20 by sliding the container 22 forward. The container 22 may be cylindrically shaped as is common in the art, and disposed in the receptacle 20 generally parallel to the longitudinal axis. This arrangement provides improved lateral balance to the device 10, by concentrating the weight of the cleaning solution supply on the longitudinal axis. The improved lateral balance likewise improves user ergonomics.

Referring to FIGS. 1 and 3, the receptacle 20 for the container 22 may be disposed in, or substantially in the handle 30. This arrangement provides the benefit of a compact form factor and improved ergonomics, due to the weight of the container 22 and cleaning solution therein being relatively close to the sole plate 14.

The container 22 may be an aerosol container 22, as is known in the art. This aerosol container 22 may use a bag on valve configuration, as is commonly known in the art. The bag on valve configuration has a bag containing cleaning solution to be dispensed onto the target surface. Propellent is disposed within the container 22 on all sides of the bag, providing pressure on all sides of the bag. This arrangement provides the benefit that the device 10 can be held, used and contact the target surface in any position and concurrently dispense cleaning solution, allowing the cleaning task to continue uninterrupted.

When the cleaning solution contained in the aerosol container 22 is depleted, it may be removed, discarded, and replaced with an aerosol container 22 having a fresh supply of cleaning solution. The container 22 of cleaning solution may likewise be replaced when a cleaning solution customized for a different cleaning task, target surface, debris, or pad 42 is desired.

If desired, the device 10 may have plural cleaning solutions mixed at the point of use. For example a first cleaning solution may be contained in an aerosol container 22 and a second cleaning solution may be contained in a hollow handle 30. Additionally or alternatively, hollow handle 20 may have a receptacle divided into plural compartments. The plural compartments may contain identical, complementary or other mutually different cleaning solutions.

The replaceable pad 42 may comprise melamine foam as is sold by the instant assignee under the name Mr. Clean® Magic Eraser®, additional bristles, woven material, nonwoven material, scrim, apertured polyolefinic film, sponge, natural and modified starch based materials, water soluble film such as PVOH, and combinations thereof. The replaceable pad 42 may be generally planar and have an outwardly facing surface for contacting the target surface and removing debris therefrom. The pad 42 may further absorb cleaning solution sprayed or otherwise dispensed through the nozzle 24.

The pad 42 may be white or of any desired color. If a color is selected, the pad 42 may be blue, green or any other desired color. The pad 42, device 10 and/or refill container may optionally comprise indicia. The indicia may comprise instructions for use, trademarks, or any other information/aesthetics considered desirable in use.

If desired, the replaceable pad 42 may be impregnated with cleaning solution. The cleaning solution may be complementary to or the same as the cleaning solution sprayed from the supply. The replaceable pad 42 may comprise melamine foam, as set forth in U.S. Pat. No. 7,629,043 or in commonly assigned 2009/172828 A1, now abandoned, or alternatively may comprise polyurethane foam, natural or synthetic sponge, and combinations thereof If desired, the replaceable pad 42 may optionally be covered with any suitable cover, such as a nonwoven, the nonwoven optionally being textured, including a microfiber nonwoven, a textured polyolefinic film and combinations thereof. The microfiber nonwoven may have a basis weight of 15 to 100 gsm, 60 to 90 gsm or 80 gsm. A microfiber nonwoven may comprise PET/Nylon, PE/PP, etc., as is known in the art.

The cover may be disposed only on the outwardly facing surface of the removable pad 42 or, alternatively, may cover the outwardly facing surface and the surface opposed thereto so that when the first surface becomes soiled, the replaceable pad 42 may simply be inverted/reattached for continued cleaning.

When the replaceable pad 42 becomes too soiled for efficacious cleaning, it may simply be removed from the sole plate 12 and discarded. A new efficacious pad 42 may then be attached to a space on the bottom 16 of the sole plate 12 and deployed for cleaning. A pad 42 comprising polyurethane foam and a 60 gsm nonwoven microfiber may provide cleaning efficacy due to the polyurethane foam absorbing and reapplying cleaning solution while the microfiber nonwoven traps debris. By absorbing and reapplying the cleaning solution during the cleaning process, less cleaning solution needs to be carried on board the device 10, so that the device 10 may be lighter in use and therefore more ergonomic.

Referring to FIG. 4, in a particular embodiment the pad 42 may comprise a laminate of three laminae: a top lamina 42T which removably contacts the sole plate 12, a center lamina 42C which absorbs/desorbs the cleaning solution and bottom lamina 42B which contacts the target surface. The laminae 42T, 42C, 42B may be adhesively joined, heat sealed, autogeniously bonded, sonically welded, etc. as are known in the art.

The pad 42 may comprise 0 to 50 weight percent cellulose, as desired for suds suppression of the cleaning solution. Thus the pad 42 and cleaning solution may work together to provide efficacious cleaning.

Examining the laminae in more detail, the top lamina 42T may allow for firm attachment to the sole plate 12 during cleaning and easy removal when the pad 42 is to be changed or discarded. The top lamina 42T may be impervious to minimize contact of the sole plate 12 with cleaning solution.

The top lamina 42T may comprise a nonwoven, or may comprise two plies joined together in face to face relationship. Such two plies may comprise a polyolefinic film and textile fabric joined together with the textile fabric facing towards the center lamina 42C. More particularly, the textile fabric may comprise a knitted nylon material. The film may comprise PE or similar impervious material. The total basis weight of the two plies in the top lamina 42T may be 20 to 40 and particularly 29 gsm.

The center lamina 42C may provide a storage core for cleaning solution and debris collected during the cleaning task. The center lamina 42C may hold, transport and/or absorb cleaning solution during cleaning and help to create suds. If desired, the center lamina 42C may have a color, such as blue, green or any other color, to signal when the pad is used and no longer suitable for further cleaning.

The center lamina 42C may comprise a high loft nonwoven. The nonwoven may comprise 70 w % PET staple fibers and 30 w % latex binder. The nonwoven may comprise PET containing bicomponent fiber with PP, PE, Nylon, Rayon, cellulose and mixture thereof. The basis weight of the center lamina 42C may be 60 to 100, 80 to 90 and particularly 85 gsm.

The bottom lamina 42B may provide cleaning, stain removal, and trapping of debris removed from the target surface. The bottom lamina 42B contacts the target surface in use and may also help to create suds at the interface with the cleaning solution.

The bottom lamina 42B may have protuberances 42P. The protuberances 42P may provide standoff from the target surface and localized increase pressure for scrubbing. The protuberances 42P may have a height ranging from 0.5 to 3 mm, particularly 1 to 1.5 mm and may be relatively stiff, so that the protuberances 42P do not collapse during use. But, collapse of the texture provided by the protuberances 42P may signal the pad 42 is depleted and should be replaced.

The bottom lamina 42B may comprise a spunbonded PET nonwoven having a basis weight of 40 to 50 and particularly 46 gsm. The protuberances may be created by solid state formation, as is known in the art.

If desired, the center lamina 42C may be entirely or partially of a color other than white, and may particularly be blue. The bottom lamina 42B and/or top lamina 42T may be white. This arrangement provides the benefit of apparent depth, allowing the user to better see when the pad 42 is torn or too soiled for further use. If the perimeter of the pad is white, the apparent depth is visually enhanced.

The pad 42 may have peripheral joining between the top lamina 42T and bottom lamina 42B, to capture the center lamina 42C therebetween. This arrangement provides the benefit that the periphery of the pad may be more flexible than the portion of the pad 42 having the center lamina 42C. Increased flexibility allows the edge of the pad 42 to further reach into corners and conform to other irregularities. Alternatively, all three laminae 42T, 42C, 42B may be perimetrically joined together.

The periphery of the pad 42 defines a perimeter. The perimeter of pad 42 may be congruent with the perimeter of the sole plate 12. The perimeter of pad 42 may be same size as or larger than the perimeter of the sole plate 12. If the perimeter of pad 42 is larger than the perimeter of the sole plate 12, the periphery of pad 42 will overhang the perimeter of the sole plate 12. The radial overhang may range from 1 to 6 and particularly 2-3 mm, and may comprise the peripheral portion of pad 42 having the top lamina 42T and bottom lamina 42B joined together without center lamina 42C therebetween.

If desired, the space in the sole plate 12 which receives the removable pad 42 may be of constant width as shown, or maybe a variable width and/or depth. If desired, two or more, different pads 42 may be inserted into the space. This arrangement allows a first pad 42 to be inserted which is customized for a particular type of cleaning and a second, or more, additional pads 42, to be likewise inserted and customized for a different type of cleaning. By simultaneously using plural replaceable pads 42, the cleaning surface of the device 10 may be customized to the particular task at hand.

Referring to FIG. 3, the device 10 may have an elongate handle 30A. The elongate handle 30A may be connected to the device through a universal joint or single-axis pivot, as is known in the art. The elongate handle 30A provides greater reach than the grip type handle 30 and may be curved or may be straight, as shown. The elongate handle 30A may be removable from the device 10, so that the device 10 is used with handle 30 for tight spaces or compact cleaning tasks.

Motive force for spraying the cleaning solution may alternatively be provided by a manual actuator, such as a trigger sprayer, as is known in the art. Alternatively, motive force may be provided by manually squeezing a flexible bag, expressing fluid therefrom, through the nozzle 24. Alternatively, the cleaning solution may be sprayed using a manually operated positive displacement pump, such as a peristolic pump, piston pump a gear pump, diaphragm pump, etc. The pump may be driven by a motor, such as a battery powered DC motor.

The device 10 according to the present invention, cleaning solution and replaceable pad 42 may be sold in a kit form. The kit may have a device 10 having a permanent cleaning material intended for prolonged and several uses. One or more supplies of cleaning solution 22 may be included in the kit form. The supplies of the cleaning solution may be mutually identical or may be different, allowing for customizing the cleaning solution choice for a particular task. Likewise, the kit may include one or more replaceable pads 42. The replaceable pads 42 may be mutually identical or may be different, allowing for customizing the pad 42 choice for a particular task.

If desired, prophetically the device 10 may be used without a pad 42 and/or with cleaning solution separately supplied, such as from a trigger pump sprayer or aerosol sold separately. This arrangement allows the device 10 to be used as a standalone.

The data in FIGS. 5, 6A, 6B, 6C, 8, and discussed below were machine generated. One or more controls and a test according to the present invention were loaded into arms run in parallel so that each arm has a parallel stroke of 126 cm.

under a force of 200 grams. The test was run with each test cleaning a ceramic tile having 0.17 to 0.26 g of greasy soap scum [GSS] soil dried thereon. The tests were run with n=6 trials.

Figure 5:
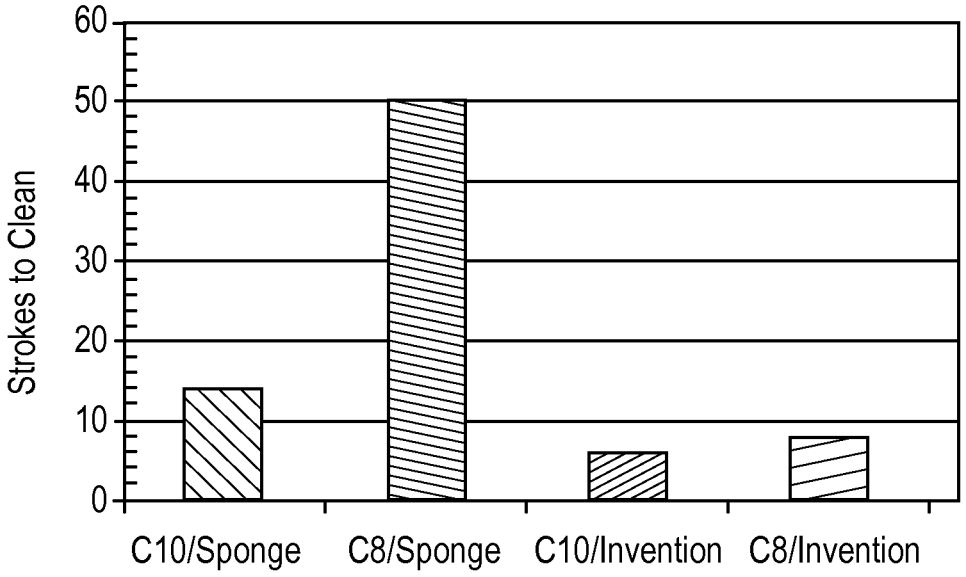
FIG. 5 is a graphical representation of the cleaning performance, as measured by the number of strokes to generate suds when cleaning a tile using an automated laboratory device, of the device of the claimed invention vs. a control sponge using cleaning solutions having C8 and C10 carbon chain lengths for n=6 test runs.
Figure 6A:
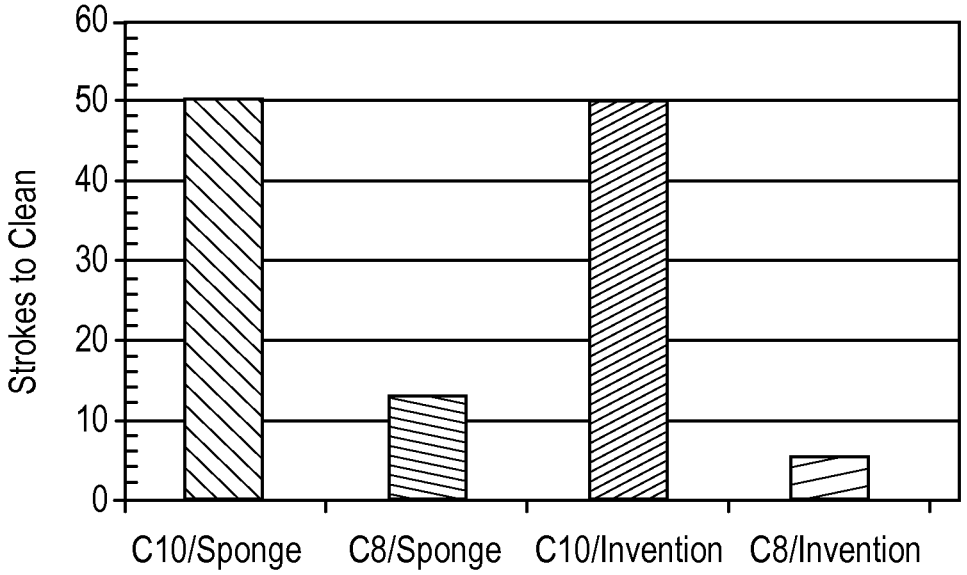
FIG. 6A is a graphical representation of the cleaning performance, as measured by the number of strokes to clean a tile using an automated laboratory device, of the device of the claimed invention, vs a control device commercially available from Rubbermaid® [RM], a control scrub brush [Sbrush] commercially available from Libman® and a control sponge commercially available from Florida Chamois and Sponge using cleaning solution having a C8 carbon chain length.
Figure 6B:
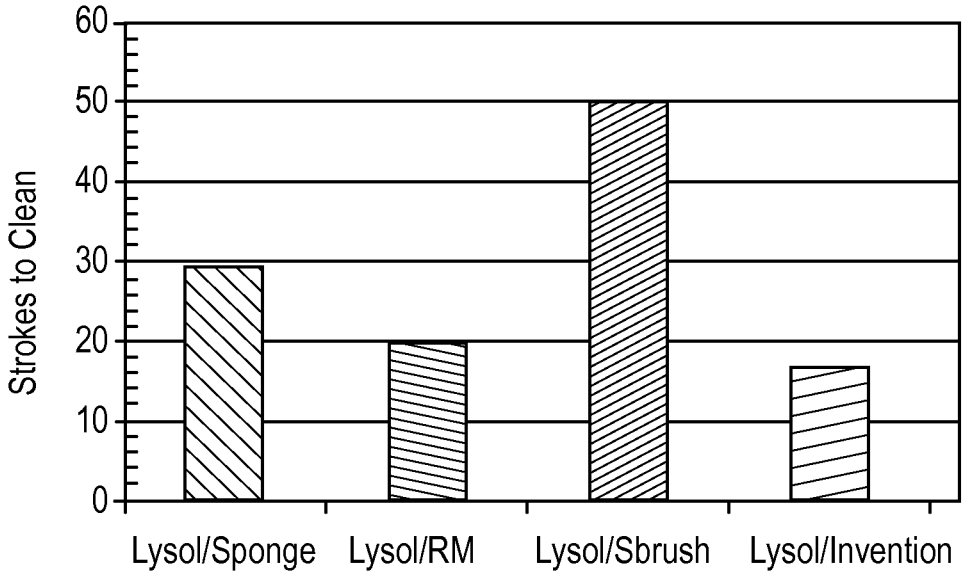
FIG. 6B is a graphical representation of the cleaning performance, as measured by the number of strokes to clean a tile using an automated laboratory device, of the device of the claimed invention, vs a control device commercially available from Rubbermaid® [RM], a control scrub brush [Sbrush] commercially available from Libman® and a control sponge commercially available from Florida Chamois and Sponge using Lysol® cleaning solution commercially available from Reckitt Benkiser.
Figure 6C:
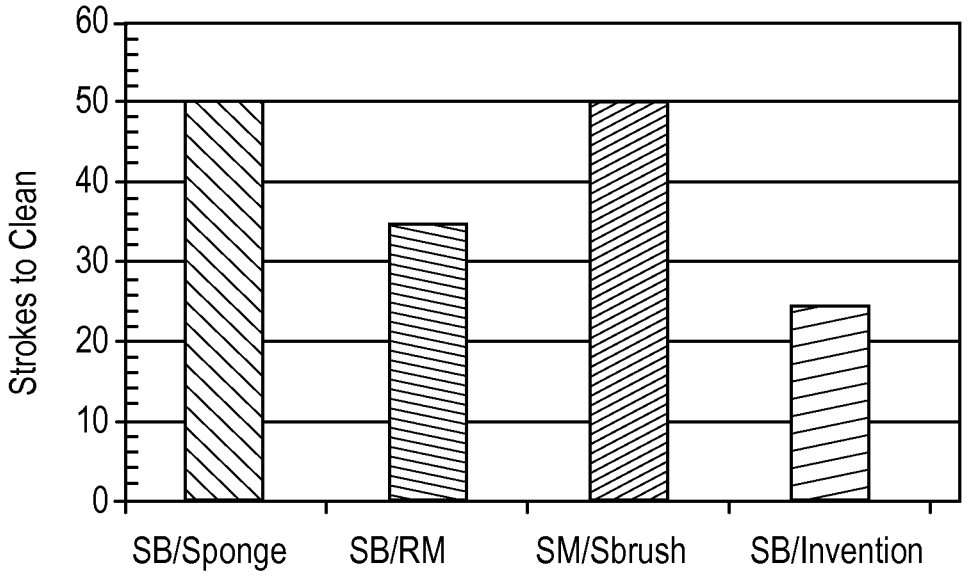
FIG. 6C is a graphical representation of the cleaning performance, as measured by the number of strokes to clean a tile using an automated laboratory device, of the device of the claimed invention, vs a control device commercially available from Rubbermaid® [RM], a control scrub brush [Sbrush] commercially available from Libman® and a control sponge commercially available from Florida Chamois and Sponge using Scrubing Bubbles® [SB] cleaning solution commercially available from SC Johnson Company.

The scrub brush used in FIGS. 6A, 6B and 6C had nylon bristles and was commercially available from Libman®. The sponge used in FIGS. 5, 6A, 6B and 6C, and all tests herein, was cellulosic and commercially available from Florida Chamois and Sponge.

The data in FIGS. 7A, 7B, 9, 10, 11 and 12 were generated by panelist cleaning a fiberglass shower having a total surface area of 39 square meters, a shower head and faucets. The shower is commercially available from Sterling Vikrell®.

These tests were run using a Rubbermaid® 2-in-1 Spray Scrubber [#1K79] with woven Disposable Pads [#1K87] as a control. The test device was according to FIGS. 1-3 with the pad 42 having the laminae 42T, 42C, 42B described above.

Referring to FIG. 5, the device 10 of the present invention was tested using the solution of the present invention having C8 and C10 chain lengths. The test pad 42 and control sponge were placed directly on the heads of the laboratory test device.

FIG. 5 shows that the number of strokes to first generate suds on the test tile were unexpectedly less for the pad 42 of the present than for a sponge. This result occurred for both cleaning solutions having the C8 and C10 carbon chain length. But, unexpectedly, this difference is not statistically significant when using the device 10 of the present invention. Thus the device 10 of the present invention unexpectedly provides greater flexibility when selecting a cleaning solution and also provides for advantageous use of a C8 cleaning solution, if desired.

Figure 8:
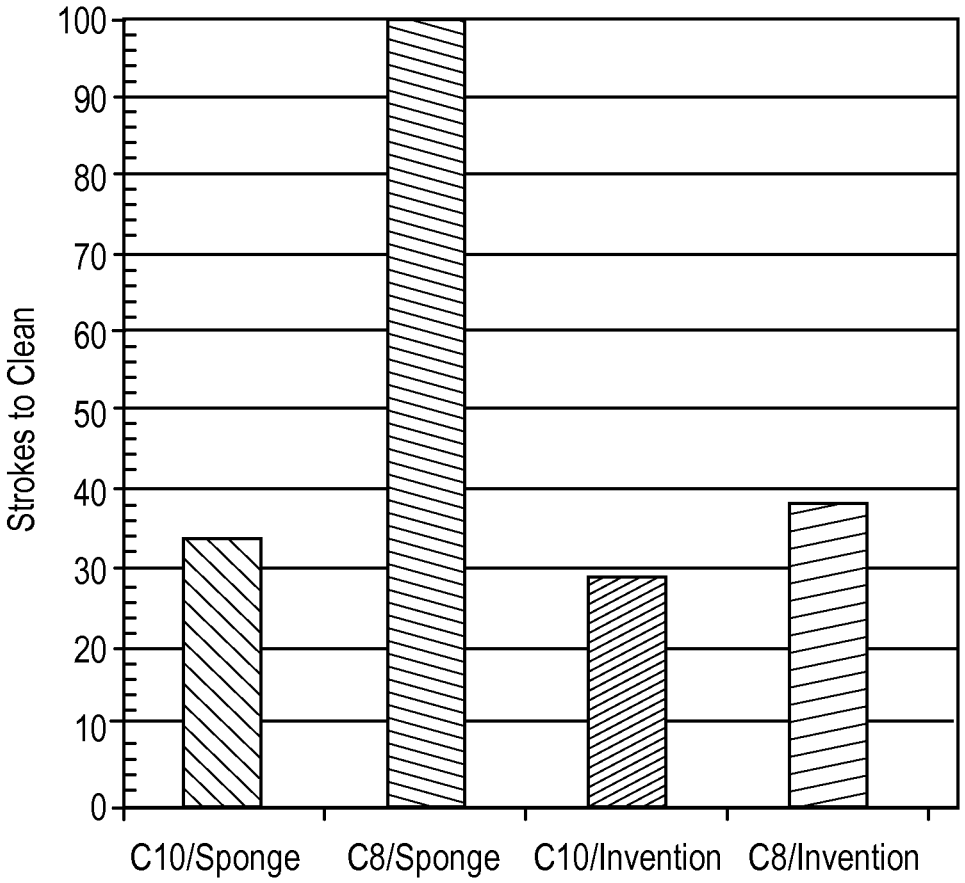
FIG. 8 is a graphical representation of the suds generation performance using an automated laboratory device of the device of the claimed invention vs. a control sponge using cleaning solutions having C8 and C10 carbon chain lengths for n=6 test runs.
Figure 10:
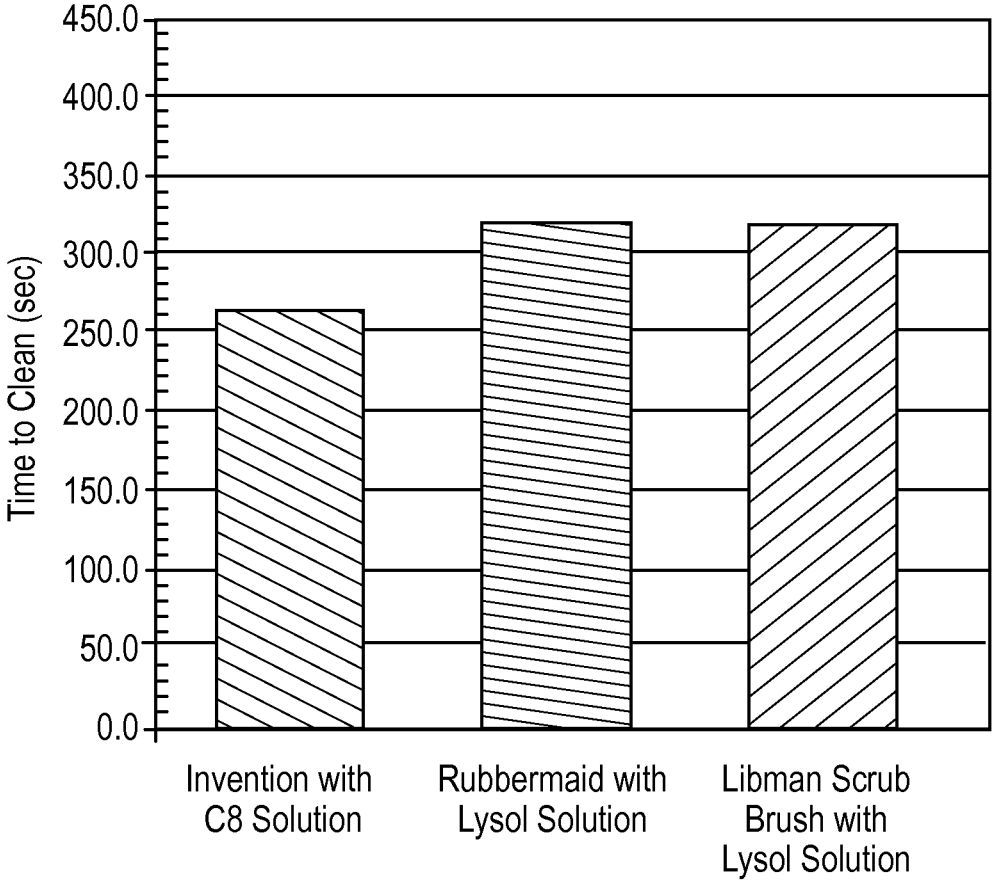
FIG. 10 is a graphical representation of the time to clean a commercially available shower using the device of the claimed invention with C8 cleaning solution vs. a control device commercially available from Rubbermaid® using Lysol® cleaning solution commercially available from Reckitt Benkiser and a control scrub brush commercially available from Libman® using Lysol® cleaning solution commercially available from Reckitt Benkiser.

FIG. 8 reinforces the results shown in FIG. 5. FIG. 8 shows that the cleaning solution having the C8 chain length requires considerably more strokes, approximately triple, to first generate suds than the cleaning solution having the C10 chain length when using sponge. FIG. 10 also unexpectedly shows that the difference in performance becomes much less pronounced when using the device 10 of the present invention.

FIGS. 6A, 6B, 6C and 8 show results of testing the aforementioned commercially available sponge, the aforementioned Rubbermaid® spray scrubber, a plastic bristle brush available from Libman® and the device 10 of the present invention according to FIGS. 1-4 with the pad 42 having the laminae 42T, 42C, 42B described above. The tests in FIGS. 6A, 6B and 6C were run using C8 cleaning solution according to the present invention, Lysol® cleaning solution available from Reckitt Benkiser and Scrubing Bubbles® cleaning solution available from SC Johnson Company.

All three tests unexpectedly show that, independent of which of the three cleaning solutions was used, the test device 10 according to present invention required the fewest strokes to clean the test tile. The closest control was generally the Rubbermaid® Spray Scrubber.

Figure 7A:
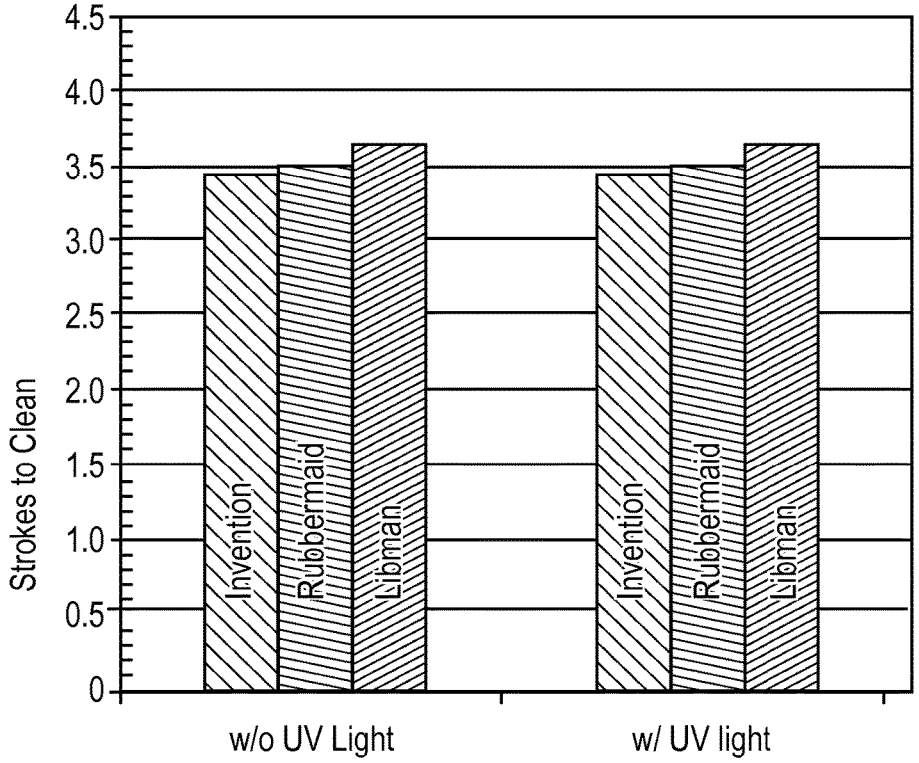
FIGS. 7A and 7B show the graphical representation of the cleaning performance in a commercially available shower of the device of the claimed invention using C8 cleaning solution (n=10 trials), vs. a control device commercially available from Rubbermaid® using Lysol® cleaning solution (n=10 trials), and control device commercially available from Libman® using Lysol® cleaning solution (n=8 trials) with FIG. 7A showing the dirt present before cleaning and FIG. 7B showing the dirt present after cleaning.
Figure 7B:
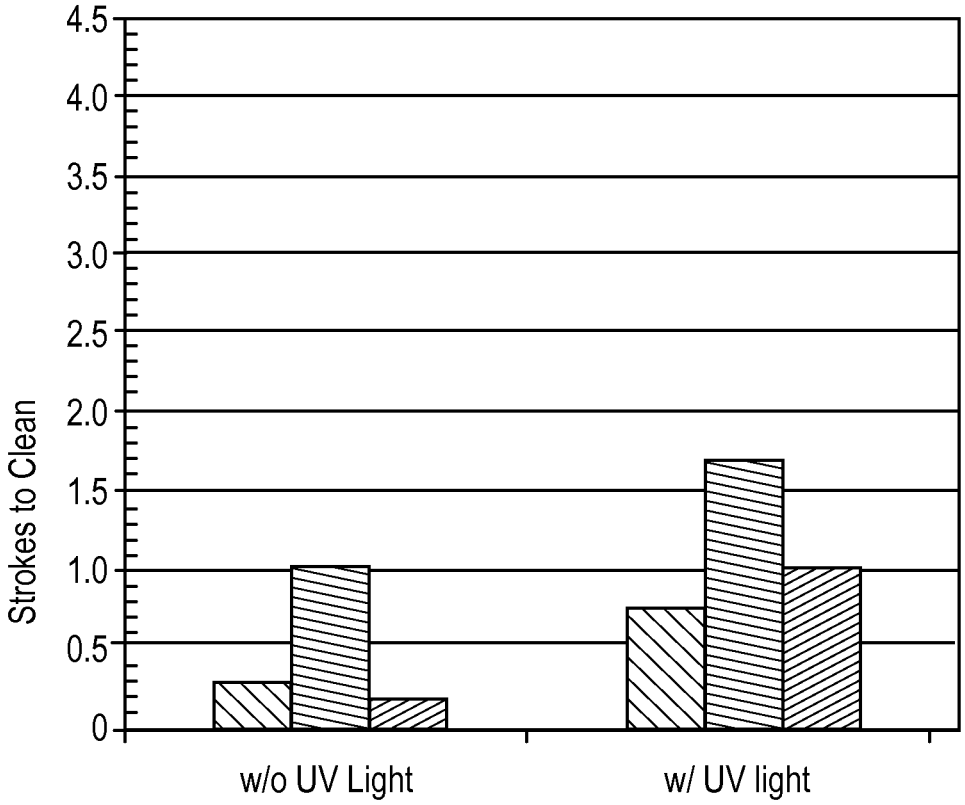

Referring to FIGS. 7A and 7B, the device 10 of the present invention and Rubbermaid® Spray Scrubber were tested in a real world configuration using the aforementioned fiberglass shower. FIGS. 7A and 7B show that the device 10 of the present invention provided superior cleaning. The cleaning was visually graded using visible light and graded again using fluorescent ultraviolet light. It is believed that use of light outside the visible spectrum revealed dirt not otherwise visually perceived during grading. Both gradings showed that the device 10 of the present invention unexpectedly provided superior cleaning over the control.

Figure 9:
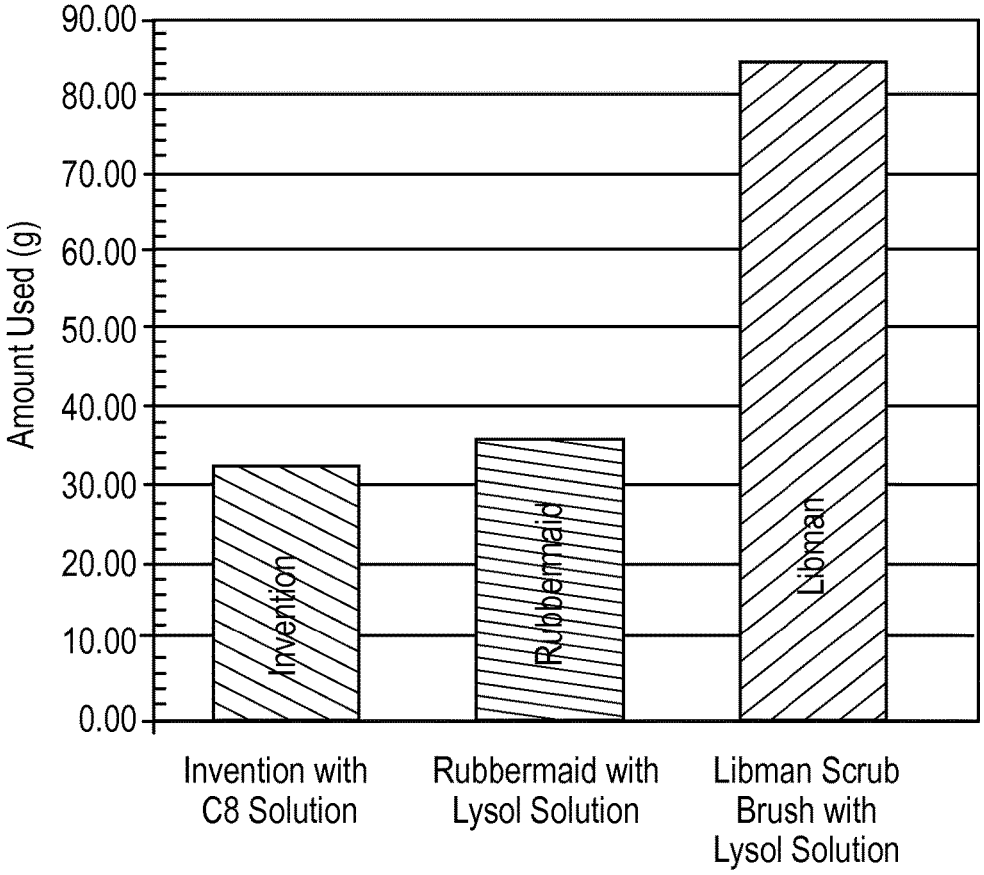
FIG. 9 is a graphical representation of the amount of the amount of C8 cleaning solution used to clean a commercially available shower using the device of the claimed invention vs. a control device commercially available from Rubbermaid® using Lysol® cleaning solution commercially available from Reckitt Benkiser and a control scrub brush commercially available from Libman® using Lysol® cleaning solution commercially available from Reckitt Benkiser.

FIG. 9 reinforces the results of FIG. 7B. FIG. 9 shows that even though the device 10 of the present invention provided superior cleaning over the controls, the device 10 advantageously required less grams of cleaning solution to do so.

FIG. 10 reinforces the results of FIGS. 9 and 7B. FIG. 10 shows that even though the device 10 of the present invention provided superior cleaning over the controls, and used less cleaning solution, the device 10 advantageously required less time in the cleaning task to do so.

Figure 11:
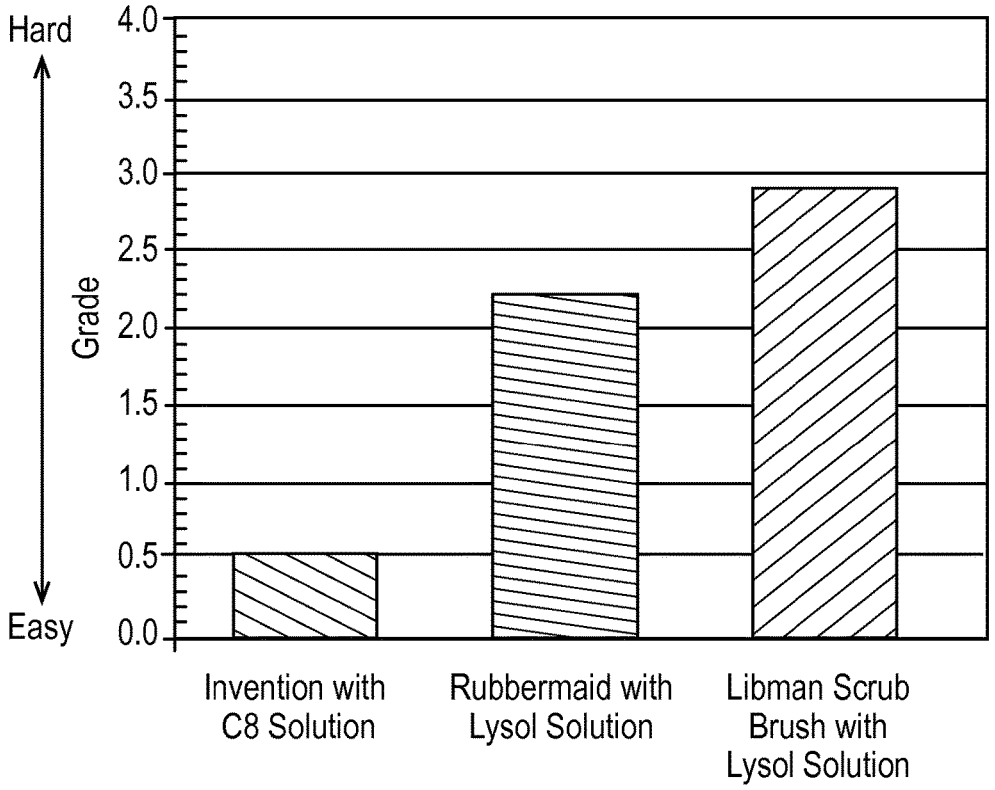
FIG. 11 is a graphical representation of the subjective ease or difficulty to clean a commercially available shower using the device of the claimed invention with C8 cleaning solution vs. a control device commercially available from Rubbermaid® using Lysol® cleaning solution commercially available from Reckitt Benkiser and a control scrub brush commercially available from Libman® using Lysol® cleaning solution commercially available from Reckitt Benkiser.

FIG. 11 reinforces the results of FIGS. 10, 9 and 7B. FIG. 11 shows that even though the device 10 of the present invention provided superior cleaning over the controls, and used less cleaning solution, in less time, the device 10 was unexpectedly advantageously subjectively judged by the panelists to be considerably easier to use than both controls.

The device 10 of the present invention was superior to the Rubbermaid® Spray Scrubber control and Libman® scrub brush control in all variables tested. That is the device 10 of the present invention unexpectedly provided superior cleaning, in less time, using less cleaning solution with greater ease of use than the controls.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A device for cleaning debris from a target surface, said device comprising:

a resiliently deformable sole plate having a top and a bottom generally opposed thereto, said bottom of said sole plate being able to removably receive a pad attachable thereto, wherein said sole plate has a peripheral flange with a perimeter;

a handle rigidly joined to the top of said sole plate;

a plurality of bristles cantilevered from said handle and extending towards a target surface to be cleaned; and a receptacle for receiving a container of cleaning solution, said container being at least partially disposed within said handle and having a nozzle for forwardly spraying cleaning solution therefrom in response to user actuation of a manual actuator disposed on said container.

2. A device according to claim 1 further comprising a generally planar pad removably installed in on the bottom of said sole plate.

3. A device according to claim 1 wherein said pad comprises cellulose.

4. A device according to claim 1 wherein said sole plate has a cantilevered sole plate perimeter.

5. A device according to claim 4 wherein said pad overhangs said sole plate a radial dimension of 1 to 10 mm.

6. A device according to claim 1 wherein said flange of said sole plate being tapered to be thinner at the perimeter thereof.

7. A device according to claim 1 wherein said sole plate comprises rubber having a Shore A Durometer hardness of 20 to 35.

8. A device according to claim 1 further comprising a cleaning solution.

9. A device according to claim 8 wherein said cleaning solution comprises a surfactant having a carbon chain length of C8 to C10.

10. A device according to claim 9 comprising cleaning solution having a surfactant with a carbon chain length of C8 and further comprising a pad, said pad further comprising less than 50% cellulose.

11. A device according to claim 10 wherein said pad comprises at least two laminae joined together in face to face relationship at least one of said laminae comprising an airlaid layer.

12. A device according to claim 1 wherein said plurality of bristles is juxtaposed with said bottom of said handle and extends outwardly therefrom in acute, non-perpendicular angular relationship relative to the bottom of said sole plate.

13. A device according to claim 12 wherein said device comprises a non-flat bristle surface, from which said bristles are outwardly cantilevered.

14. A device according to claim 1 wherein said receptacle is elongate with an opening at each end thereof.

15. A kit according to claim 1 wherein said container is an aerosol container removably insertable into said receptacle.

16. A kit according to claim 15 wherein said aerosol container has a bag on valve configuration.

17. A kit according to claim 15 having a receptacle longitudinal axis through said receptacle, and said aerosol container has a container longitudinal axis, said container longitudinal axis being coincident said aerosol longitudinal axis.

18. A kit according to claim 17 wherein said sole plate is spaced apart a first distance from receptacle longitudinal axis.

* * * * *